US006038421A

United States Patent [19]

Yoshino et al.

[11] Patent Number: 6,038,421

[45] Date of Patent: Mar. 14, 2000

[54] IMAGE FORMING APPARATUS USING A LIQUID DEVELOPMENT SYSTEM

[75] Inventors: Mie Yoshino, Kanagawa; Masahiko Itaya, Tokyo; Noriyasu Takeuchi, Kanagawa, all of Japan

[73] Assignee: Ricoh Company, Ltd., Tokyo, Japan

[21] Appl. No.: 09/281,962

[22] Filed: Mar. 31, 1999

[30] Foreign Application Priority Data

Apr. 1, 1998 [JP] Japan ..... 10-107066
Apr. 1, 1998 [JP] Japan ..... 10-107067

[51] Int. Cl.[7] ..... G03G 15/10

[52] U.S. Cl. ..... 399/239; 399/240; 430/117

[58] Field of Search ..... 399/75, 237, 239, 399/240, 222; 430/117, 118, 119; 222/DIG. 1; 74/63, 70

[56] References Cited

U.S. PATENT DOCUMENTS 3,406,660 10/1968 Simm ..... 399/239 X
5,477,313 12/1995 Kuramochi et al. ..... 399/239
5,652,080 7/1997 Yoshino et al. ..... 430/119
5,666,616 9/1997 Yoshino et al. ..... 399/240
5,708,938 1/1998 Takeuchi et al. ..... 399/250
5,826,148 10/1998 Iino et al. ..... 399/240
5,826,149 10/1998 Horii et al. ..... 399/240
5,937,247 8/1999 Takeuchi et al. ..... 399/237

*Primary Examiner*—Sophia S. Chen
*Attorney, Agent, or Firm*—Oblon, Spivak, McClelland, Maier & Neustadt, P.C.

[57] ABSTRACT

An image forming apparatus of the type depositing a developing liquid on a developing sleeve in the form of a thin layer, developing a latent image formed on a photoconductive element with the liquid and transferring the resulting toner image to a recording medium is disclosed. The developing sleeve is implemented as a conductive hollow tubular member. A drive roller is rotatably disposed in the bore of the developing sleeve and extends in the axial direction of the sleeve. A cleaning blade is pressed against the outer periphery of the sleeve for pressing the drive roller via the sleeve. The drive roller and cleaning blade cooperate to cause the sleeve to rotate. An applicator roller applies the liquid to the outer periphery of the sleeve. An electric field for development is formed in a developing region between the photoconductive drum and the sleeve. The liquid is transferred from the sleeve to the latent image formed on the drum for thereby developing it.

20 Claims, 3 Drawing Sheets

IMAGE FORMING APPARATUS USING A LIQUID DEVELOPMENT SYSTEM

BACKGROUND OF THE INVENTION

The present invention relates to a copier, facsimile apparatus, printer or similar image forming apparatus and more particularly to an image forming apparatus of the type causing a developing liquid to form a thin layer on a developer carrier and contact a latent image formed on an image carrier, and transferring the resulting toner image to a recording medium.

An image forming apparatus of the type described includes a developing unit for developing a latent image electrostatically formed on a photoconductive element or similar image carrier with charged toner. To miniaturize the developing unit, it has been proposed to use a dense viscous developing liquid consisting of an insulating liquid and toner dispersed in the liquid with a relatively high content. Japanese Patent Laid-Open Publication No. 7-209922, for example, teaches a developing method using a viscous developing liquid consisting of an insulating liquid and toner dispersed therein with a content as high as 100 to 10,000 mPa·S. This developing liquid is applied to a conductive developer carrier and brought into contact with an image carrier in order to develop a latent image.

Another conventional developing unit of the type using a developing liquid includes a developer carrier implemented by a flexible endless belt for applying the liquid to the image carrier. The belt is passed over and driven by a plurality of belt rollers. An applicator roller feeds the liquid from a tank to the belt in the form of a thin layer.

The problem with the above developing unit using the endless belt as a developer carrier is how the belt should be driven. When the belt is driven under tension by a plurality of belt rollers, the axes of the belt rollers must be precisely parallel to each other in order to prevent the belt from being displaced in the axial direction of the rollers. It is therefore necessary to arrange, e.g., a mechanism for adjusting the axis of each belt roller in a portion supporting the belt roller. As a result, a structure for supporting the belt and a driveline for driving the belt are complicated and expensive.

Moreover, the above developing unit needs a great number of parts including the belt rollers and is therefore bulky. Such a developing unit would increase the overall size of, e.g., a color image forming apparatus including a plurality of developing units.

SUMMARY OF THE INVENTION

It is therefore an object of the present invention to provide a small size, low cost image forming apparatus using a liquid development system and capable of stably forming high quality images.

An image forming apparatus of the present invention uses a developing liquid consisting of a dielectric carrier liquid and toner dispersed in the carrier liquid, and causes the developing liquid to form a layer on a developer carrier and contact an image carrier on which a latent image is electrostatically formed to thereby develop the latent image. The apparatus includes a developer carrier implement by a hollow tubular member. A drive roller is rotatably disposed in the bore of the developer carrier for causing the developer carrier to rotate. A pressing member is pressed against the outer periphery of the developer carrier for exerting a pressure on the drive roller via the developer carrier.

An image forming method of the present invention is applicable to the above type of image forming apparatus.

The method begins with the step of rotating a developer carrier in the form of a conductive hollow tubular member with a drive roller rotatably disposed in the bore of the developer carrier and extending in the axial direction of the developer carrier and a pressing member pressed against the outer periphery of the developer carrier for exerting a pressure on the drive roller. The developing liquid is caused to form a thin layer on the outer periphery of the developer carrier by an applicator roller. An electric field for development is formed in a developing region between the image carrier and the developer carrier. The developing liquid is transferred from the developer carrier to the latent image formed on the image carrier to thereby it.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
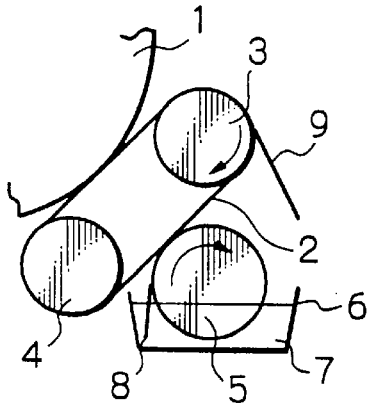
Fig. 1 PRIOR ART
FIG. 1 is a sectional view showing a conventional developing unit included in an image forming apparatus.

To better understand the present invention, brief reference will be made to a conventional image forming apparatus, shown in FIG. 1. As shown, the apparatus includes a photoconductive element or image carrier implemented as a drum 1. A developer carrier for feeding a developing liquid (simply liquid hereinafter) 7 to the drum 1 is implemented as a flexible endless belt 2 passed over a drive roller 3 and a driven roller 4. The liquid 7 is stored in a tank 6. An applicator roller 5 applies the liquid 7 to the belt 2 in the form of a thin layer. FIG. 2 shows another conventional image forming apparatus. As shown, the belt 2 is directly immersed in the liquid 7 stored in the tank 6.

Figure 2:
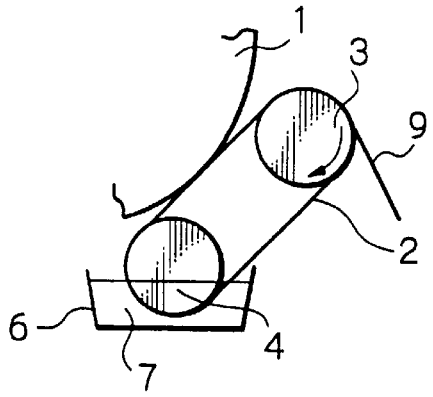
Fig. 2 PRIOR ART
FIG. 2 is a sectional view showing another conventional developing unit.

In the configuration shown in FIG. 1, a metering blade 8 removes excessive part of the liquid 7 from the applicator roller 5, so that the liquid 7 forms a layer of preselected thickness on the belt 2. In both of the configurations shown in FIGS. 1 and 2, a cleaning blade 9 removes the liquid 7 developed a latent image formed on the drum 1.

The conventional apparatuses shown in FIGS. 1 and 2 have some problems left unsolved, as discussed earlier.

Figure 3:
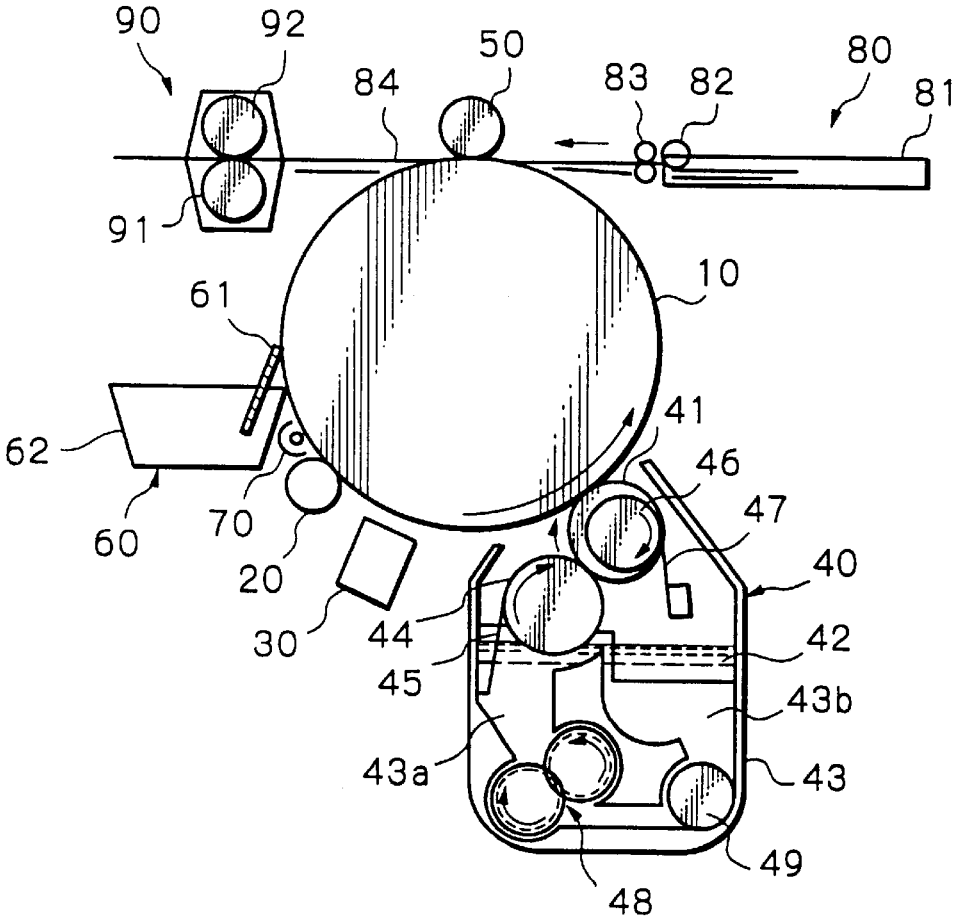
FIG. 3 is a sectional view showing an image forming apparatus embodying the present invention.

Referring to FIG. 3, an image forming apparatus embodying the present invention is shown and implemented as an electrophotographic copier by way of example. As shown, the copier includes a photoconductive drum or image carrier 10. A charge roller or charging means 20 uniformly charges the surface of the drum 10. An exposing unit or writing means 30 electrostatically writes a latent image on the charged surface of the drum 10. A developing unit or developing means 40 develops the latent image. A transfer roller or transferring means 50 transfers the developed image or toner image to a paper or similar recording medium 84. A cleaning unit or cleaning means 60 cleans the drum 10. A discharger or discharging means 70 discharges the surface of the drum 10.

The developing unit 40 includes a developing sleeve or developer carrier 41. A tank 43 stores a developing liquid (simply liquid hereinafter) 42 made up of a dielectric carrier and toner dispersed in the carrier. The liquid 42 has a viscosity as high as 100 to 1,000 mPa·s. An applicator roller 44 has its lower portion immersed in the liquid 42. A metering blade 45 regulates the thickness of the liquid 42 being conveyed by the applicator roller 44. A drive roller 46 causes the developing sleeve 41 to rotate. A cleaning blade 47 scrapes off the liquid 42 applied to the developing sleeve 41 by the applicator roller 44. Of course, the above range of viscosity of the liquid 42 is only illustrative.

In operation, while the drum 10 is rotated in a direction indicated by an arrow in FIG. 3, the charge roller 20 uniformly charges the surface of the drum 10 to a preselected potential. Optics included in the exposing unit 30 focuses a reflection from a document on the charged surface of the drum 10. As a result, a latent image is electrostatically formed on the drum 10 in accordance image data. In the developing device 40, the viscous liquid 42 is deposited on the circumference of the developing sleeve 41 in the form of a thin layer. The liquid 42 on the developing sleeve 41 develops the latent image at a nip where the drum 10 and sleeve 41 contact each other, thereby producing a corresponding toner image.

A paper feeder 80 includes a cassette 81, a pick-up roller 82, and a separator roller 83. The paper feeder 80 feeds the previously mentioned paper 84 toward the surface of the drum 10, as indicated by an arrow in FIG. 3. The toner image is transferred from the drum 10 to the paper 84 at a nip where the drum 10 and transfer roller 50 contact each other. A peeler, not shown, peels off the paper 84 to which the toner image has been transferred from the drum 10. Subsequently, the paper or printing is conveyed to a fixing unit or fixing means 90 including a heat roller 91 and a press roller 92. After the toner image has been fixed on the paper 84, the paper 84 is driven out to a tray, not shown, mounted on the outside of the apparatus body.

At the time of image transfer from the drum 10 to the paper 84, some toner is left on the drum 10 without being transferred to the paper 84. The cleaning unit 60 removes such toner from the drum 10 with a cleaning blade 61 and collects it in a container 62. After the removal of the toner left on the drum 10, the discharger 70 dissipates charge also left on the drum 10, i.e., discharges the drum 10.

The applicator roller 44 of the developing unit 40 is not essential. For example, the lower portion of the developing sleeve 41 may be immersed in the liquid 42 like the belt 2, FIG. 2, immersed in the liquid 7.

In the developing unit 40, a gear pump 48 is positioned in the vicinity of the bottom of the tank 43 for circulating the liquid 42 within the tank 43. The gear pump 48 divides the tank 43 into two chambers, i.e., a liquid feed chamber 43*a* and a liquid collection chamber 43*b*. The applicator roller 44 is positioned in an upper portion of the liquid feed chamber 43*a* which is formed at the discharge side of the gear pump 48. The gear pump 48 forces the liquid existing in the liquid feed chamber 43*a* upward and thereby feeds it to the applicator roller 44. At this instant, excessive part of the liquid 42 not deposited on the circumference of the applicator roller 44 is directly introduced into the liquid collection chamber 43*b* formed at the suction side of the gear pump 48 due to gravity.

The liquid applied to the developing sleeve 41 by the applicator roller 44, but not used to develop the latent image formed on the drum 10, is removed from the sleeve 41 by the cleaning blade 47. This part of the liquid drops into the liquid collection chamber 43*b* due to gravity.

Assume that the circumference of the developing sleeve 41 is not cleaned after the development of the latent image. Then, the liquid remains on the sleeve 41 in portions not corresponding to the latent image. When the liquid is newly applied to the sleeve 41 over the liquid left on the sleeve 41, the latent image directly appears in the resulting liquid layer as irregular thickness. As a result, the liquid left on the sleeve 41 brings about a ghost and thereby critically degrades the toner image transferred to the paper 84.

The liquid 42 consists of a carrier, which is an insulating liquid, and toner dispersed in the carrier, as stated earlier. If such a liquid 42 is left unused over a long period of time, it is likely that the carrier and toner are separated from each other or that the distribution of the toner in the carrier becomes irregular.

Further, the liquid removed from the developing sleeve 41 by the cleaning blade 47 and returned to the liquid collection chamber 43*b* has a toner content varied in accordance with the area ratio of the image. It is therefore necessary to readjust the toner content of the liquid by, e.g., replenishing a fresh carrier liquid.

For the above reasons, the developing unit using the liquid 42 must be provided with stirring means for evenly distributing the toner in the carrier liquid.

In the illustrative embodiment, a stirrer or stirring means in the form of a roller 49 is positioned on a circulation path connecting the gear pump 48 and the liquid collection chamber 43*b*. While the liquid 42 is circulated between the two chambers 43*a* and 43*b* by the gear pump 48, it is stirred by the roller 49 with the result that the toner is dispersed in the carrier to a preselected content. If desired, the roller 49 may be replaced with any other suitable stirring means, e.g., a screw roller with a spiral blade.

In the developing unit 40, the tank 43 has a closed configuration except for its portion where the developing sleeve 41 contacts the drum 10. The tank 43 therefore prevents the liquid 42 from spilling when the apparatus body tilts or shakes. Further, the circulating means disposed in the tank 43 allows the dimension of the tank 43 to be increased in the direction of gravity and thereby renders the developing unit 40 compact.

The gear pump 48 may be replaced with any other suitable circulating means so long as the circulating means is capable of feeding the liquid 42 to the applicator roller 44. For example, use may be mace of circulating means implemented by a piston and a one-way valve.

The developing sleeve 41 should preferably be flexible so as not to damage the surface of the drum 10. For the sleeve 41, use may be made of a roller whose surface is covered with rubber or similar elastic material, a roller having sponge or similar member having low elasticity thereinside, or a tubular belt member. The sleeve 41 may be formed of nylon or polyimide by way of example.

When the sleeve 41 is implemented by a tubular belt member, a method of driving it is the problem. Specifically, as shown in FIGS. 1 and 2, assume that the sleeve 41 is implemented as the belt or tubular belt member 2 passed over the drive roller 3 and driven roller 4. Then, the prerequisite is that the axis of the drive roller 3 and that of the driven roller 4 be precisely parallel to each other in order to obviate the axial displacement of the belt 2, as stated earlier.

It follows that the developing unit of the type using the belt 2 implemented by a tubular belt member needs a plurality of belt rollers arranged between the opposite runs of the belt 2, increasing the number of parts of the unit. As a result, a structure for supporting the belt 2 and drive means for driving the belt 2 are complicated and expensive and increase the overall size of the developing unit. This is particularly true with, e.g., a color image forming apparatus including a plurality of developing units.

Figure 4:
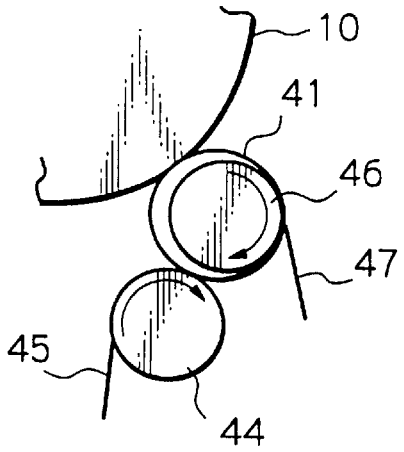
FIGS. 4–11 are fragmentary sectional views of the illustrative embodiment.

In light of the above, as shown in FIG. 4, the developing sleeve 41 is implemented as a hollow tubular member while a single drive roller 46 is positioned in the bore of the sleeve 41. The drive roller 46 has a diameter smaller than the inside diameter of the developing sleeve 41 and rotatably supports part of the inner periphery of the sleeve 41. The cleaning blade 47 is pressed against the sleeve or roller 41 so as to exert a pressure on the drive roller 46 via the roller 41. In this sense, the cleaning blade 47 plays the role of a pressing member.

In the above configuration, the drive roller 46 rotates while sandwiching the developing sleeve 41 between it and the cleaning blade 47. As a result, the sleeve 41 is caused to rotate by friction acting between it and the drive roller 46. It follows that the sleeve 41 is free from axial displacement only if the drive roller 46 and cleaning blade 47 are maintained parallel to each other. That is, the configuration shown in FIG. 4 is capable of obviating the displacement of the sleeve 41 more easily than the configurations shown in FIGS. 1 and 2.

As stated above, the above developing unit needs a minimum number of parts for supporting and driving the developing sleeve 41. Therefore, structures for supporting and driving the sleeve 41 are simple and low cost and reduce the overall size of the developing unit.

When the drive roller 46 drives the developing sleeve 41 while sandwiching the sleeve 41 between it and the cleaning blade 47, as stated above, the blade 47 must be pressed against the sleeve 41 in such a manner as to remove most of the liquid left on the sleeve 41 without stopping or slowing down the rotation of the sleeve 41.

Further, the drive roller 46 must drive the sleeve 41 in pressing contact with the inner periphery of the sleeve 41 without stopping or slowing down the rotation of the sleeve 41. For this purpose, the sleeve 41 should preferably be rotated at a peripheral speed Sa equal to or higher than the peripheral speed Sb of the drum 10, i.e., Sa>Sb.

Assume that the peripheral speed Sa of the sleeve 41 is higher than the peripheral speed Sb of the drum 10. Then, the sleeve 41 scoops up a greater amount of liquid for a unit period of time and therefore increases the amount of liquid to deposit on the drum 10. This brings about some different changes including an increase in the density of the resulting toner image formed on the drum 10. An increase in image density, however, does not directly translate into the degradation of the toner image.

On the other hand, assume that the peripheral speed Sa of the sleeve 41 is lower than the peripheral speed Sb of the drum 10. Then, the sleeve 41 scoops up a smaller amount of liquid for a unit period of time and thereby reduces the amount of liquid to deposit on the drum 10. This lowers the density of the toner image formed on the drum 10 and therefore degrades the toner image transferred to the paper 84. This is why the peripheral speed Sa of the sleeve 41 should preferably be equal to or higher than the peripheral speed Sb of the drum 10.

More specifically, even when a difference in peripheral speed occurs between the inner periphery of the sleeve 41 and the outer periphery of the drive roller 46, image quality can be prevented from being critically lowered if the peripheral speed Sa is selected to be equal to or higher than the peripheral speed Sb beforehand.

The coefficient of friction Fb between the end of the cleaning blade 47 contacting the sleeve 41 and the outer periphery of the sleeve 41 should preferably be smaller than the coefficient friction Fa between the inner periphery of the sleeve 41 and the outer periphery of the drive roller 46. That is, a relation Fa>Fb should preferably hold. This can be done if the surfaces (roughness) of the sleeve 41, drive roller 46 and cleaning blade 47 contacting each other and pressures to act therebetween are adequately selected.

With the above relation Fa>Fb, it is possible to prevent the inner periphery of the sleeve 41 and the outer periphery of the drive roller 46 from slipping on each other while the drive roller 46 is in rotation. The sleeve 41 can therefore surely feed the developer 42 to the drum 10.

The cleaning blade 47 playing the role of pressing means for pressing the sleeve 41 against the drive roller 46 is only illustrative and may be replaced with any other suitable pressing means so long as it satisfies the above relation. For example, use may be made of a roller facing the drive roller 46 with the intermediary of the sleeve 41. However, the cleaning blade 47 serving as the pressing means at the same time is capable of implementing a more compact and inexpensive developing unit.

Figure 5:
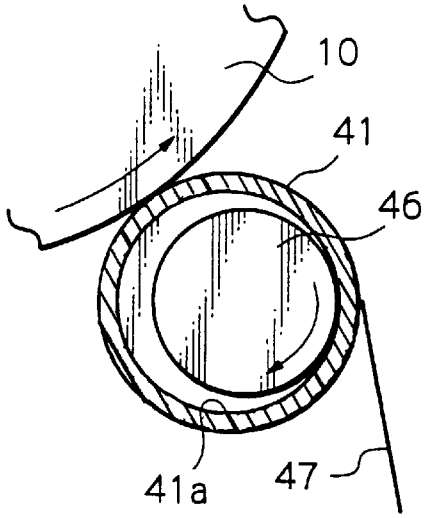

FIG. 5 shows a specific implementation for allowing the cleaning blade 47 and drive roller 46 to smoothly drive the sleeve 41. As shown, a high friction layer 41*a* is formed on the inner periphery of the sleeve 41 and implemented by, e.g., a rubber layer.

Figure 6:
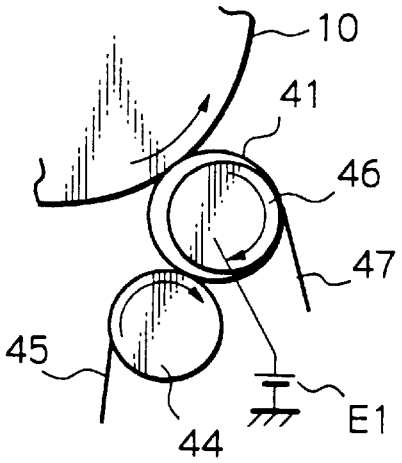

Now, to develop a latent image formed on the drum 10 by use of the developing sleeve 41, it is necessary to form an electric field in accordance with the potential of the latent image in the developing region between the drum 10 and the sleeve 41. As shown in FIG. 6, in accordance with the present invention, the sleeve 41 is implemented by a conductive hollow tubular member. The drive roller 46 supporting part of the inner periphery of the sleeve 41 for driving the sleeve 41 has at least its portion contacting the sleeve 41 formed of a conductive material. A voltage is applied from a power source E1 to the drive roller 46 in order to form an electric field having a preselected potential in the above developing region.

Because the sleeve 41 and drive roller 46 are pressed against each other by a preselected pressure, the voltage applied to the drive roller 46 deposits the same potential on the sleeve 41. Particularly, the sleeve 41 and drive roller 46 driving the sleeve 41 are caused to surely contact each other, so that a stable voltage can be applied to the sleeve 41.

Figure 7:
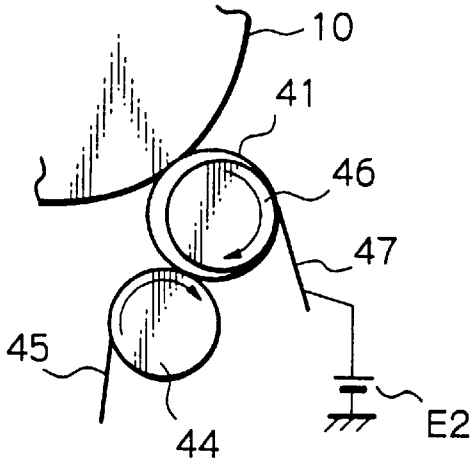

FIG. 7 shows another specific arrangement for forming the electric field in the developing region between the drum 10 and the sleeve 41. As shown, the cleaning blade 47 contacting the outer periphery of the sleeve 41 is formed of a conductive material. A preselected voltage is applied from a power source E2 to the cleaning blade 47. The cleaning blade 47 serves to clean the sleeve 41 and to press the sleeve 41 against the drive roller 46 at the same time, as stated earlier. Therefore, the cleaning blade 47 and sleeve 41 are held in close contact with each other in an extremely stable condition. It follows that the voltage applied to the blade 47 deposits the same potential on the sleeve 41, allowing a stable voltage to be applied to the sleeve 41.

When the pressing means is implemented by a roller facing the drive roller 46 via the sleeve 41, the roller may be formed of a conductive material and applied with the voltage for forming the electric field for development. In this case, the roller should preferably face the part of the sleeve 41 between the position where the cleaning blade 47 cleans the sleeve 41 and the position where the applicator roller 44 applies the liquid 42 to the sleeve 41.

The configuration of FIG. 7 using the cleaning blade 47 as the pressing means and applying a voltage to the blade 47 is advantageous in that it renders the developing unit more compact and insures stable voltage application.

Figure 8:
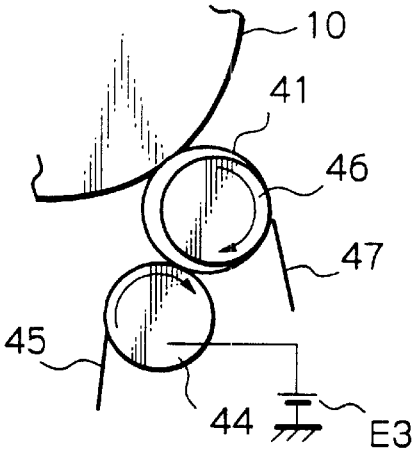

FIG. 8 shows another specific arrangement for forming the electric field in the developing region between the drum 10 and the sleeve 41. As shown, a preselected voltage is applied from a power source E3 to the applicator roller 44. Specifically, the applicator roller 44 s constantly held in contact with the sleeve 41 during image formation (development). It is therefore possible to apply a stable voltage to the sleeve 41 even with the arrangement shown in FIG. 8.

Figure 9:
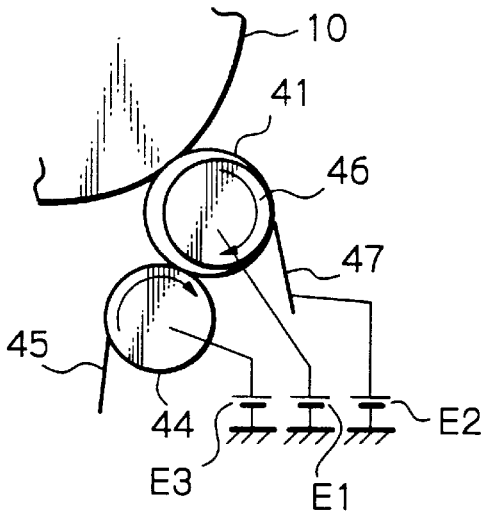

Further, as shown in FIG. 9, a particular voltage may be applied to each of the drive roller 46, cleaning blade 47 and applicator roller 44 from the respective power source E1, E2 or E3.

Figure 10:
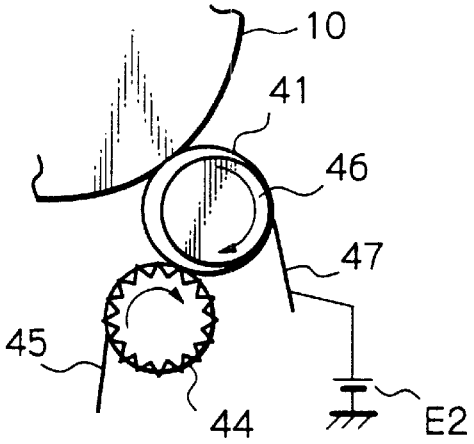

As shown in FIG. 10, the applicator roller 44 may be implemented by a photogravure roller whose surface is engraved with a pattern. In this case, the engraved portion of the applicator roller 44 removes an excessive portion of the liquid 42 fed to the surface of the roller 44. The applicator roller 44 can therefore accurately measure the amount of the liquid 42 applied to its surface. It follows that the liquid 42 is transferred from the applicator roller 44 to the sleeve 41 in an accurately measured amount, forming a thin layer having a uniform thickness on the sleeve 41.

To free the layer on the sleeve 41 from irregularity ascribable to the pattern of the photogravure roller, the portion of the applicator roller 44 facing the sleeve 41 may be moved in the opposite direction to the portion of the sleeve 41 facing the drive roller 46.

Figure 11:
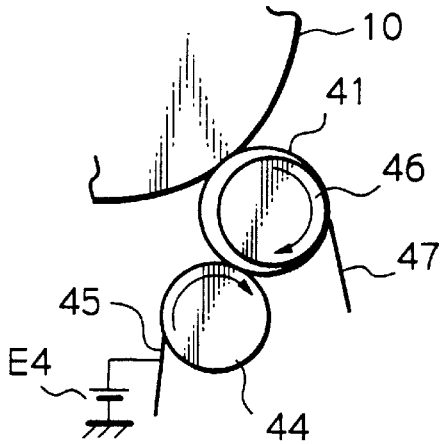

As shown in FIG. 11, a voltage for forming the electric field for development may be applied from a power source E4 to the metering blade 45 which regulates the amount of the liquid 42 to deposit on the applicator roller 44. In this case, the metering blade 45 should be formed of a conductive material. A stable voltage can be applied from the power source E4 to the sleeve 41 because the metering blade 45 is pressed against the applicator roller 44 which is, in turn, held in contact with the sleeve 41.

The drive roller 46, cleaning blade 47, applicator roller 44 and meter in,g blade 45 which are conductive or partly conductive are provided with a volume resistivity ranging from zero to $10^8$ Ω·cm. Experiments showed that such a range of volume resistivity stabilizes the application of a voltage to the sleeve 41 and forms a stable electric field in the developing region between the drum 10 and the sleeve 41, enhancing image quality.

In summary, it will be seen that the present invention provides an image forming apparatus having various unprecedented advantages, as enumerated below.

(1) A developing unit needs a minimum number of parts. Therefore, a structure for supporting a developer carrier and drive means for driving the developer carrier are simple and low cost, promoting the miniaturization of the developing unit. This is also true with e.g., a color image forming apparatus including a plurality of developing units.

(2) Even with a minimum number of parts, it is possible to uniformly apply a developing liquid to the developer carrier.

(3) A frictional force Fa between the inner periphery of the developer carrier and the outer periphery of a drive roller is selected to be greater than a frictional force Fb between the outer periphery of the developer carrier and a pressing member. This successfully prevents the inner periphery of the developer carrier and the outer periphery of the drive roller from slipping on each other while the drive roller is in rotation. The liquid can therefore be surely fed to an image carrier via the developer carrier.

(4) The inner periphery of the developer carrier driven by the drive roller is entirely or partly covered with a high friction layer. This prevents the inner periphery of the developer carrier and the outer periphery of the drive roller from slipping each other more positively and thereby further promotes the stable application of the liquid to the image carrier.

(5) While the drive roller is in rotation, it causes the developer carrier to rotate at a peripheral speed Sa higher than the peripheral speed Sb of the image carrier. This obviates the short supply of the liquid to the image carrier via the developer carrier for a unit period of time and thereby prevents image density from decreasing.

(6) Pressing means is implemented by a cleaning blade used to scrape off the liquid deposited on the developer carrier. This renders the drive means for the developer carrier compact and low cost.

(7) The developer carrier is held between the drive roller and the pressing member and therefore surely held in contact with them. This, coupled with the fact that an applicator roller surely contacts the developer carrier, allows a stable electric field for development to be formed in a developing region between the image carrier and the developer carrier with a small size, simple configuration.

(8) The applicator roller is implemented by a photogravure roller engraved with a pattern. The engraved portion of such a roller removes excessive part of the liquid from the roller. It follows that the liquid is fed to the applicator roller in an accurately measured amount, forming a layer having a uniform thickness on the image carrier.

(9) A metering blade having a conductive surface is held in contact with the circumference of the photogravure roller. The engraved portion of the photogravure roller and the metering blade cooperate to remove the excess liquid more positively. This is also successful to achieve the above advantage (8).

Various modifications will become possible for those skilled in the art after receiving the teachings of the present disclosure without departing from the scope thereof.

What is claimed is:

1. An image forming apparatus using a developing liquid consisting of a dielectric carrier liquid and toner dispersed in said carrier liquid, and causing said developing liquid to form a layer on a developer carrier and contact an image carrier on which a latent image is electrostatically formed to thereby develop said latent image, said image forming apparatus comprising:

said developer carrier implemented by a hollow tubular member;

a drive roller rotatably disposed in a bore of said developer carrier for causing said developer carrier to rotate; and a pressing member pressed against an outer periphery of said developer carrier for exerting a pressure or said drive roller via said developer carrier, wherein a frictional force Fa acting between an inner periphery of said developer carrier and an outer periphery of said drive roller while said drive roller is in rotation is selected to be greater than a frictional force Fb acting between the outer periphery of said developer carrier and said pressing member.

2. An apparatus as claimed in claim 1, wherein said drive roller causes said developer carrier to move at a peripheral speed Sa higher than or equal to a peripheral speed Sb of said image carrier.

3. An apparatus as claimed in claim 1, wherein said pressing member comprises a cleaning blade used to scrape off the developing liquid fed to the outer periphery of said developer carrier.

4. An image forming apparatus using a developing liquid consisting of a dielectric carrier liquid and toner dispersed in said carrier liquid, and causing said developing liquid to form a layer on a developer carrier and contact an image carrier on which a latent image is electrostatically formed to thereby develop said latent image, said image forming apparatus comprising:

said developer carrier implemented by a hollow tubular member;

a drive roller rotatably disposed in a bore of said developer carrier for causing said developer carrier to rotate;

a pressing member pressed against an outer periphery of said developer carrier for exerting a pressure on said drive roller via said developer carrier; and an applicator roller for applying the developing liquid to the outer periphery of said developer carrier, wherein a frictional force Fa acting between an inner periphery of said developer carrier and an outer periphery of said drive roller while said drive roller is in rotation is selected to be greater than a frictional force Fb acting between the outer periphery of said developer carrier and said pressing member.

5. An apparatus as claimed in claim 4, wherein the inner periphery of said developer carrier driven by said drive roller in contact with said drive roller is at least partly covered with a high friction layer.

6. An apparatus as claimed in claim 5, wherein said drive roller causes said developer carrier to move at a peripheral speed Sa higher than or equal to a peripheral speed Sb of said image carrier.

7. An apparatus as claimed in claim 6, wherein said pressing member comprises a cleaning blade used to scrape off the developing liquid fed to the outer periphery of said developer carrier.

8. An image forming apparatus using a developing liquid consisting of a dielectric carrier liquid and toner dispersed in said carrier liquid, and causing said developing liquid to form a layer on a developer carrier and contact an image carrier on which a latent image is electrostatically formed to thereby develop said latent image, said image forming apparatus comprising:

said developer carrier implemented by a hollow tubular member;

a drive roller rotatably disposed in a bore of said developer carrier for causing said developer carrier to rotate; and a pressing member pressed against an outer periphery of said developer carrier for exerting a pressure on said drive roller via said developer carrier, wherein an inner periphery of said developer carrier driven by said drive roller in contact with said drive roller is at least partly covered with a high friction layer.

9. An image forming method using a developing liquid consisting of a dielectric carrier liquid and toner dispersed in said carrier liquid for causing said developing liquid to form a layer on a developer carrier and contact an image carrier on which a latent image is electrostatically formed to thereby develop said latent image, said image forming method comprising the steps of:

rotating said developer carrier in a form of a conductive hollow tubular member with a drive roller rotatably disposed in a bore of said developer carrier and extending in an axial direction of said developer carrier and a pressing member pressed against an outer periphery of said developer carrier for exerting a pressure on said drive roller;

causing the developing liquid to form a thin layer on the outer periphery of said developer carrier with an applicator roller;

forming an electric field for development in a developing region between said image carrier and said developer carrier; and transferring the developing liquid from said developer carrier to the latent image formed on said image carrier to thereby develop said latent image, wherein said drive roller has at least a portion thereof contacting said developer carrier formed of a conductive material, and wherein a voltage is applied to said drive roller for forming the electric field.

10. A method as claimed in claim 9, wherein said applicator roller comprises a photogravure roller whose surface is engraved with a preselected pattern.

11. A method as claimed in claim 10, wherein said applicator roller is conductive and held in contact with a metering blade having a conductive surface, and wherein a voltage is applied to said metering blade for forming the electric field.

12. A method as claimed in claim 11, wherein said drive roller, said applicator roller and said metering blade each has a volume resistivity ranging from zero to $10^8$ Ω·cm in at least a conductive portion thereof.

13. A method as claimed in claim 12, wherein said pressing member comprises a cleaning blade for scraping off the developing liquid fed to said developer carrier.

14. A method as claimed in claim 9, wherein said pressing member has at least a portion thereof contacting said developer carrier formed of a conductive material, and wherein a voltage is applied to said pressing member for forming the electric field.

15. A method as claimed in claim 9, wherein said applicator roller has at least a portion thereof contacting said developer carrier formed of a conductive material, and wherein a voltage is applied to said applicator roller for forming the electric field.

16. A method as claimed in claim 9, wherein said applicator roller is conductive and held in contact with a metering blade having a conductive surface, and wherein a voltage is applied to said metering blade for forming the electric field.

17. A method as claimed in claim 9, wherein said pressing member comprises a cleaning blade for scraping off the developing liquid fed to said developer carrier.

18. An image forming method using a developing liquid consisting of a dielectric carrier liquid and toner dispersed in said carrier liquid for causing said developing liquid to form a layer on a developer carrier and contact an image carrier on which a latent image is electrostatically formed to thereby develop said latent image, said image forming method comprising the steps of:

rotating said developer carrier in a form of a conductive hollow tubular member with a drive roller rotatably disposed in a bore of said developer carrier and extending in an axial direction of said developer carrier and a pressing member pressed against an outer periphery of said developer carrier for exerting a pressure on said drive roller;

causing the developing liquid to form a thin layer on the outer periphery of said developer carrier with an applicator roller;

forming an electric field for development in a developing region between said image carrier and said developer carrier; and transferring the developing liquid from said developer carrier to the latent image formed on said image carrier to thereby develop said latent image, wherein at least two of said driver roller, said pressing member and said applicator roller each has a portion thereof contacting said developer carrier formed of a conductive material, and wherein a voltage is applied to each of said at least two of said drive roller, said pressing remember and said applicator roller for forming the electric field.

19. A method as claimed in claim 18, wherein said applicator roller comprises a photogravure roller whose surface is engraved with a preselected pattern.

20. An image forming method using a developing liquid consisting of a dielectric carrier liquid and toner dispersed in said carrier liquid for causing said developing liquid to form a layer on a developer carrier and contact an image carrier on which a latent image is electrostatically formed to thereby develop said latent image, said image forming method comprising the steps of:

rotating said developer carrier in a form of a conductive hollow tubular member with a drive roller rotatably disposed in a bore of said developer carrier and extending in an axial direction of said developer carrier and a pressing member pressed against an outer periphery of said developer carrier for exerting a pressure on said drive roller;

causing the developing liquid to form a thin layer on the outer periphery of said developer carrier with in applicator roller;

forming an electric field for development in a developing region between said image carrier and said developer carrier; and transferring the developing liquid from said developer carrier to the latent image formed on said image carrier to thereby develop said latent image, wherein said applicator roller is held in contact with a metering blade, and wherein said drive roller, said applicator roller and said metering blade each has a volume resistivity ranging from zero to $10^8$ Ω·cm in at least a conductive portion thereof.

* * * * *